United States Patent [19]

Nelson

[11] Patent Number: 4,869,683

[45] Date of Patent: Sep. 26, 1989

[54] PROTECTIVE ENCLOSURE FOR ELECTRICAL PLUG CONNECTIONS

[76] Inventor: Llewellyn W. Nelson, Rte. 9, Box 2631, Elizabethton, Tenn. 37643

[21] Appl. No.: 301,482

[22] Filed: Jan. 26, 1989

[51] Int. Cl.[4] ..... H01R 13/52; H01R 13/639

[52] U.S. Cl. ..... 439/369; 174/138 F; 439/275; 439/367; 439/371; 439/523; 439/892

[58] Field of Search ..... 439/271, 275, 367, 369, 439/371, 521, 523, 892, 915; 174/138 F

[56] References Cited

U.S. PATENT DOCUMENTS

| | | | |
|---|---|---|---|
| 3,014,194 | 12/1961 | Berglund | 439/369 |
| 3,030,601 | 4/1962 | Krebs | 439/369 |
| 3,059,209 | 10/1962 | Bird | 439/369 |
| 3,187,090 | 6/1965 | Edwards | 174/138 F |
| 4,143,934 | 3/1979 | Siebert | 439/369 |
| 4,643,505 | 2/1987 | House et al. | 439/369 |
| 4,690,476 | 9/1987 | Morgenrath | 439/369 |

OTHER PUBLICATIONS

"Sporty's" Tool Catalog, 1988, p. 26.

*Primary Examiner*—Steven C. Bishop
*Attorney, Agent, or Firm*—Norman B. Rainer

[57] ABSTRACT

A device is provided for protectively enclosing coupled terminals of mated industrial gauge electrical cords. The device, which can accommodate terminals and cords of varying size, easily creates a water-impervious shield encompassing the coupled terminals. The device is comprised of a flexible sheath having two longitudinal edges interengageable by a zipper to form a tubular structure. Binding straps disposed upon the exterior surface of the sheath adjacent each tubular extremity apply compressive force to underlying sealing bands which grip the electrical cord.

7 Claims, 3 Drawing Sheets

PROTECTIVE ENCLOSURE FOR ELECTRICAL PLUG CONNECTIONS

BACKGROUND OF THE INVENTION

The present invention relates to the coupling of mating terminals of electrical cords, and more particularly concerns an enclosure which excludes water from said coupled terminals.

In certain industrial applications, heavy duty electrical conductor cords capable of handling 220–440 volts, and having mating terminals are coupled, and the coupled region is exposed to weather conditions or utilized in a harbor environment where immersion in water is likely. In such conditions of use, penetration of the coupling by water or water-borne contaminates can disrupt the electrical system and may lead to damage of the terminals, potentially dangerous sparking, and possible electrocution of personnel.

Numerous housings have earlier been disclosed for the purpose of preventing inadvertent separation of coupled electrical terminals, and some of said housings are further intended to prevent entrance of water into the coupling. However, such earlier housings have been designed primarily for use on electrical cords carrying household electrical currents of 110–120 volts. If such housings were to be scaled up in size to accommodate larger diameter cables which handle high industrial voltages, their weight and size would be impractical. Certain earlier housings are not adaptable to use with terminals and cords of varied size, some are difficult to emplace, and some are of expensive complex construction.

It is accordingly an object of the present invention to provide an enclosure capable of preventing entrance of water into the region of coupled terminals of heavy duty electrical cords.

It is a further object of this invention to provide an enclosure as in the foregoing object which can be easily emplaced upon the region of said coupled terminals.

It is another object of the present invention to provide an enclosure of the aforesaid nature of relatively light weight and capable of adjusting in size to accommodate electrical cords of various diameter.

It is a still further object of this invention to provide an enclosure of the aforesaid nature of simple construction, resistant to breakage, and amenable to low cost manufacture.

These objects and other objects and advantages of the invention will be apparent from the following description.

SUMMARY OF THE INVENTION

The above and other beneficial objects and advantages are accomplished in accordance with the present invention by an enclosure device for a coupling consisting of the mated terminals of two electrical cord members, said device comprising:

(a) a water impervious flexible sheath having interior and exterior surfaces, two end extremities, and two mating longitudinal edges, (b) zipper means associated with said longitudinal edges, (c) a sealing band of compressibly resilient material disposed upon said interior surface adjacent each end extremity in substantially perpendicular relationship to said longitudinal edges, said bands having a proximal portion affixed to said interior surface, and a free distal portion adapted to pass beneath said zipper and abut with said proximal portion to form a closed circle, and (d) a binding strap having a proximal portion attached to a first site on said exterior surface in overlying alignment with each sealing band and having a free distal portion adapted to cross perpendicularly above the mated longitudinal edges and releasibly engage said exterior surface at a second site, whereby (e) when the sheath is wrapped around said coupling with its longitudinal edges in general alignment with said electrical cords, and the zipper means is drawn to interengage said edges, an enclosure is formed wherein each end extremity encircles a cord member, said enclosure being rendered water impervious by causing the distal extremities of said binding strips to engage the second sites of said exterior surface under tension, causing said underlying sealing band to compressively engage the respective cord member.

In preferred embodiments of the invention, the sheath member is fabricated of a compliant strong material resistant to outdoor weathering factors. Such material include, for example, neoprene rubber, polyurethane rubber, and silicones. The sheath member may be a monolithic sheet or may be a fabric-reinforced composite structure. The zipper means is preferably of a water-impervious construction. The sealing bands are preferably fabricated of flat strips of closed cell polymer foam material such as neoprene, polyolefin and polyurethane. The proximal portions of the sealing bands are preferably adhered to the interior surface of the sheath in a water-impervious manner. The binding straps preferably have VELCRO fastening means on their distal portions, adapted to interact with a complimentary piece of VELCRO affixed to said second site of the exterior surface.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
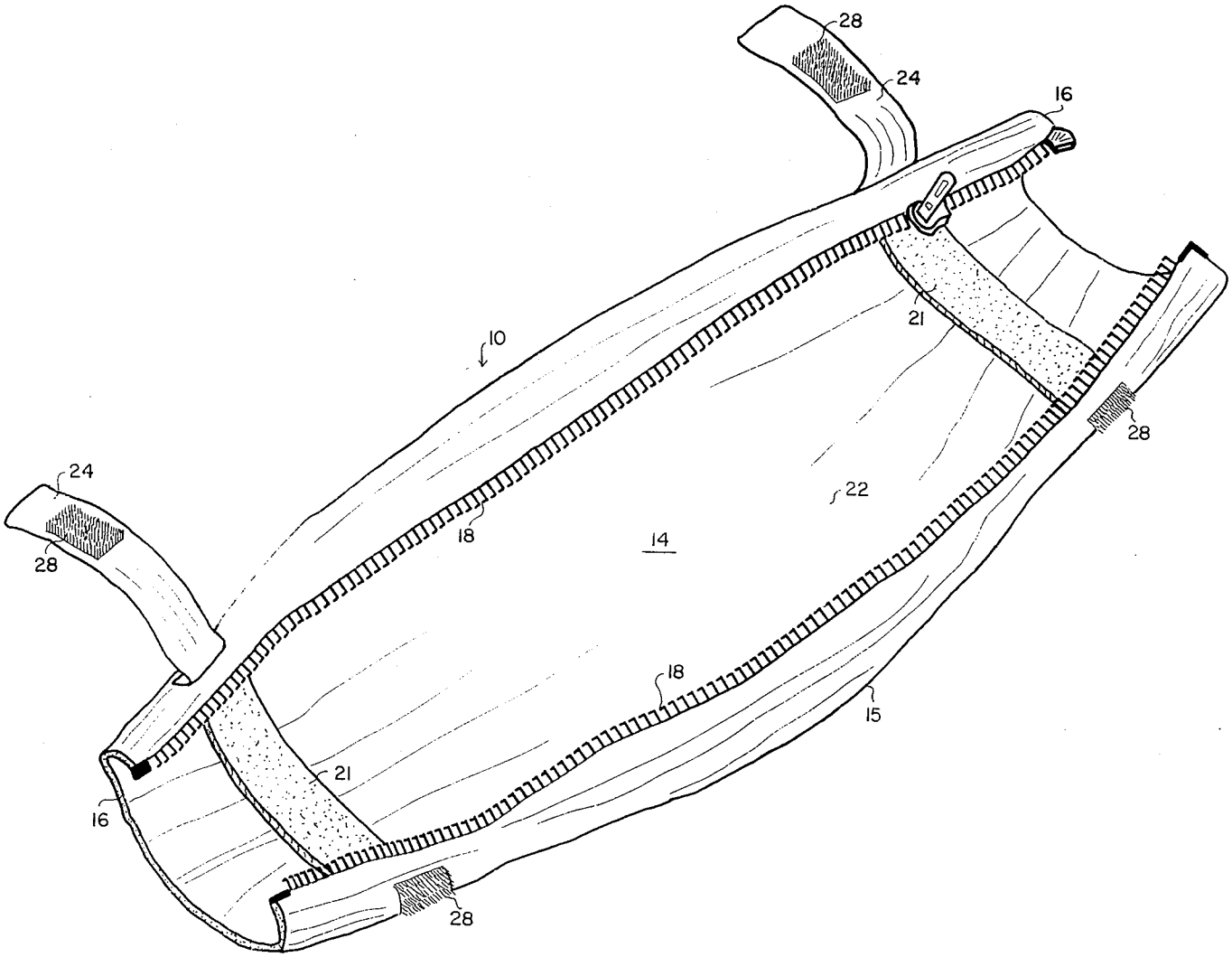
FIG. 1 shows an embodiment of the enclosure device in its opened state.
Figure 2:
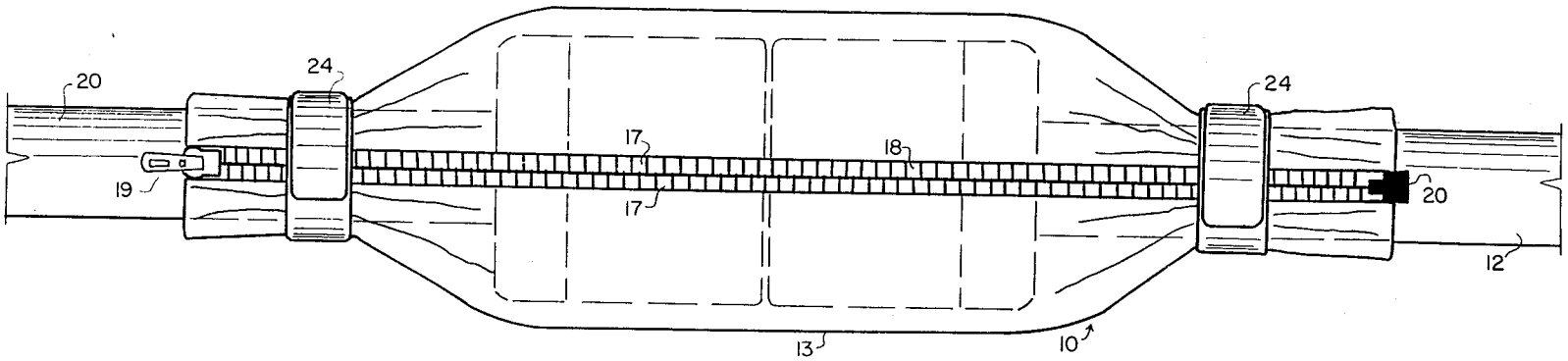
FIG. 2 is a side view of the enclosure device of FIG. 1 in its closed state in functional relationship with an electrical coupling.

Referring to FIGS. 1–4, an embodiment of the enclosure device 10 of the present invention is shown in association with a coupling comprised of mated terminals 11 and their cord members 12.

The enclosure device is comprised of flexible sheath 13 having interior and exterior surfaces 14 and 15 respectively, two end extremities 16, and two mating longitudinal edges 17 which extend between said end extremities 16.

Zipper means 18 are associated with edges 17 along their entire length. One end 19 of the zipper may be considered the manipulating end, and the opposite end 20 may be considered the closed end.

Figure 3:
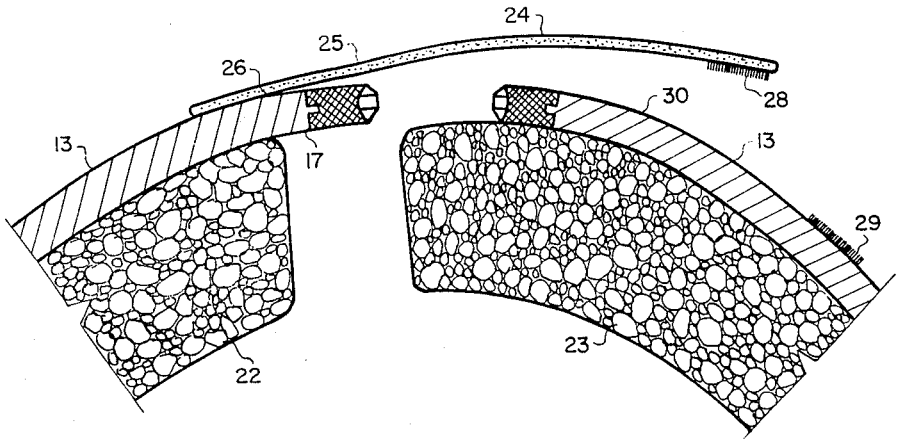
FIG. 3 is an enlarged fragmentary sectional view, showing the configuration of the device prior to its closed state.
Figure 4:
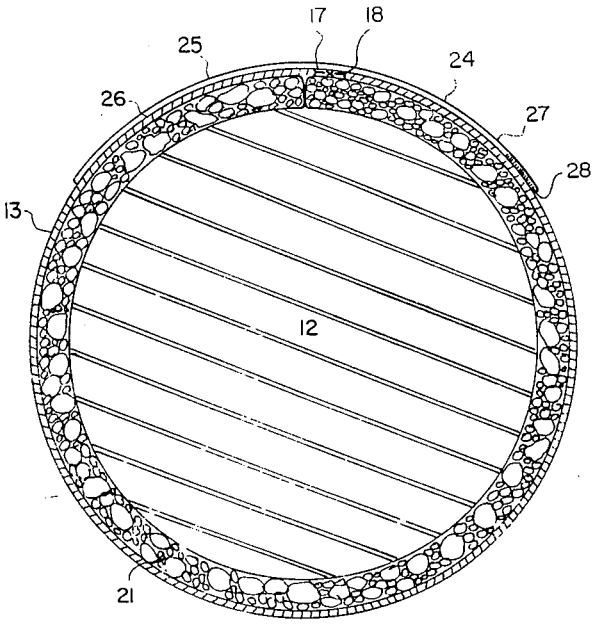
FIG. 4 is substantially the same view as FIG. 3, showing the device in its closed state.

A flat sealing band 21 of compressively resilient material is disposed upon said interior surface adjacent each end extremity 16 in substantially perpendicular relationship to longitudinal edges 17. Each band has a proximal portion 22 which is adhered to said interior surface, and a free distal portion 23. In the closed state of the enclosure, as best shown in FIGS. 3 and 4, the distal portion is shown adapted to pass beneath zipper means 18 and abut with proximal portion 22 to form a closed circle which tightly embraces cord member 12.

A binding strap 24 is disposed above each sealing band 21. Each binding strap is comprised of a proximal portion 25 attached to a first site 26 on said exterior surface, and a free distal portion 27 adapted to cross perpendicularly above zipper means 18. Attached to the lower surface of distal portion 27 is a first piece of hook and loop attachment material 28 adapted to releasibly engage a second piece of hook and loop attachment material 29 affixed to said exterior surface at a second site 30. Suitable hook and loop type attachment material is commercially available under the trademark VELCRO from the Velcro Corporation of New York. Such hook and loop attachment or fastening material are paired interactive members, each comprising a compliant base sheet having an upraised pile of synthetic fibers. The fibers of one member are in the form of loops. The fibers of the other interactive member are cut loops, which constitute hooks. When the two members of the fastening system are pressed together in face-to-face relationship, there is substantial engagement of hook fibers with loop fibers. A considerable effort must be applied to separate the members unless they are peeled apart, in which event the members are easily separated.

It is to be noted that the sealing bands 21 and associated binding straps 24 are positioned slightly closer together than the end extremities 16. Such positioning causes the underlying zipper means 18 to extend beyond the binding straps to end extremities 16. By virtue of such positioning, the binding straps serve the additional function of preventing inadvertent opening of the zipper means from either end.

Because the sheath is compliant and forms a tube-like structure when closed by the zipper, it can embrace couplings of various sizes and shapes to provide a light weight enclosure. The ability of the sealing bands and binding straps to adjust to form a closed circular circumference enables the device to form a water-impervious enclosure upon couplings having various diameter cord members.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An enclosure device for a coupling consisting of the mated terminals of two electrical cord members, said device comprising:

(a) a water impervious flexible sheath having interior and exterior surfaces, two end extremities, and two mating longitudinal edges, (b) zipper means associated with said longitudinal edges, (c) a sealing band of compressibly resilient material disposed upon said interior surface adjacent each end extremity in substantially perpendicular relationship to said longitudinal edges, said bands having a proximal portion affixed to said interior surface, and a free distal portion adapted to pass beneath said zipper and abut with said proximal portion to form a closed circle, and (d) a binding strap having a proximal portion attached to a first site on said exterior surface in overlying alignment with each sealing band and having a free distal portion adapted to cross perpendicularly above the mated longitudinal edges and releasibly engage said exterior surface at a second site, whereby (e) when the sheath is wrapped around said coupling with its longitudinal edges in general alignment with said electrical cords, and the zipper means is drawn to interengage said edges, an enclosure is formed wherein each end extremity encircles a cord member, said enclosure being rendered water impervious by engagement of the distal extremities of said binding straps with the second sites of said exterior surface under tension, causing said underlying sealing band to compressively engage the respective cord member.

2. The device of claim 1 wherein said sheath member is fabricated of a compliant strong material resistant to outdoor weathering factors.

3. The device of claim 1 wherein said zipper means is of a water-impervious construction.

4. The device of claim 1 wherein said sealing bands are flat strips of closed cell polymer foam.

5. The device of claim 4 wherein said polymer is a member selected from the group consisting of neoprene, polyolefin and polyurethane.

6. The device of claim 1 wherein the proximal portions of the sealing bands are adhered to the interior surface of said sheath in a water-impervious manner.

7. The device of claim 1 wherein the binding straps have hook and loop fastening material on their distal portions, configured to interact with complimentary hook and loop fastening material affixed to said second site of the exterior surface of the sheath.

* * * * *